US009334719B2

(12) United States Patent
Rytlewski et al.

(10) Patent No.: US 9,334,719 B2
(45) Date of Patent: May 10, 2016

(54) EXPLOSIVE PELLET

(75) Inventors: Gary L. Rytlewski, League City, TX (US); Jorge Lopez De Cardenas, Sugar Land, TX (US); Raymond Dickes, Sugar Land, TX (US); Philip Kneisl, Pearland, TX (US); Timothy A. Andrzejak, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 194 days.

(21) Appl. No.: 13/485,546

(22) Filed: May 31, 2012

(65) Prior Publication Data

US 2013/0032337 A1 Feb. 7, 2013

Related U.S. Application Data

(60) Provisional application No. 61/514,404, filed on Aug. 2, 2011.

(51) Int. Cl.

| | |
|---|---|
| ***E21B 43/26*** | (2006.01) |
| ***F42B 3/11*** | (2006.01) |
| ***E21B 43/263*** | (2006.01) |
| ***F42B 3/117*** | (2006.01) |

(52) U.S. Cl.

CPC ..... *E21B 43/263* (2013.01); *F42B 3/117* (2013.01)

(58) Field of Classification Search

CPC ..... E21B 43/26; E21B 43/263; E21B 43/267; E21B 49/006

USPC ..... 166/250.1, 299, 308.1, 63, 280.2

See application file for complete search history.

(56) References Cited

U.S. PATENT DOCUMENTS

| | | | | |
|---|---|---|---|---|
| 3,948,176 | A | 4/1976 | Koomen | |
| 4,057,780 | A | 11/1977 | Shuck | |
| 4,557,771 | A | 12/1985 | Bencz et al. | |
| 4,912,941 | A * | 4/1990 | Buchi | 62/260 |
| 5,945,627 | A | 8/1999 | Arpin et al. | |
| 7,134,492 | B2 | 11/2006 | Willberg et al. | |
| 8,168,570 | B2 * | 5/2012 | Barron et al. | 507/269 |
| 2004/0226715 | A1 * | 11/2004 | Willberg et al. | 166/250.1 |
| 2009/0288820 | A1 * | 11/2009 | Barron et al. | 166/249 |
| 2012/0181020 | A1 * | 7/2012 | Barron et al. | 166/250.1 |
| 2013/0032337 | A1 * | 2/2013 | Rytlewski et al. | 166/250.1 |
| 2013/0327529 | A1 * | 12/2013 | Sprouse | 166/308.1 |

FOREIGN PATENT DOCUMENTS

WO WO 2015116662 A1 * 8/2015 ..... F42B 1/00

OTHER PUBLICATIONS

Appealing Products, Inc., ChemNote: Azides, Uses, Properties, Toxicity, and Safety, Detection, Safe Decontamination, and Destruction, 2011, 8 pages.*

International Search Report and Written Opinion mailed May 15, 2013 for International Application No. PCT/US2012/048916, 12 pages.

* cited by examiner

*Primary Examiner* — Jennifer H Gay

(74) *Attorney, Agent, or Firm* — Tuesday Kaasch

(57) ABSTRACT

An explosive pellet for characterizing a fracture in a subterranean formation is provided. The pellet can include a casing having a detonation material and an explosive material disposed within the casing. The pellet can also include a nonexplosive material moveably disposed within the casing. Movement of the nonexplosive material can generate a predetermined amount of energy in the form of friction-generated heat sufficient to detonate the explosive material.

13 Claims, 6 Drawing Sheets

EXPLOSIVE PELLET

CROSS-REFERENCE TO RELATED APPLICATIONS

This application claims the benefit of and priority to U.S. provisional patent application having Ser. No. 61/514,404 that was filed on Aug. 2, 2011; which is incorporated by reference herein in its entirety.

BACKGROUND

One conventional method for characterizing the features of hydraulic fractures includes hydraulic fracture monitoring (HFM). HFM uses an array of geophones to map microseismic events that occur in the reservoir rock by the creation of a fracture. Oftentimes, however, the acoustic energy created by the rock when it is fractured is too minor to detect, or the acoustic energy is generated by adjacent portions of the rock, rather than the fracture itself, producing inaccurate results.

Increased accuracy can be achieved by introducing explosive pellets into the fracture and monitoring the acoustic energy generated by the pellets when they explode. The pellets are adapted to be heated by the fluid within the reservoir and to detonate at a predetermined temperature. Accordingly, the pellets are designed to detonate at a temperature less than or equal to the reservoir temperature. For shallow reservoirs having a temperature less than about 100° C., the transportation and storage of the pellets can be dangerous, however, because the pellets are designed to detonate at a temperature less than or equal to 100° C. In some climates, such pellets can be exposed to temperatures close to or exceeding 100° C. during transportation and in storage.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

An explosive pellet for characterizing a fracture in a subterranean formation is provided. The pellet can include a casing having a detonation material and an explosive material disposed within the casing. The pellet can also include a nonexplosive material moveable disposed within the casing. Movement of the nonexplosive material can generate a predetermined amount of energy in the form of friction-generated heat sufficient to detonate the explosive material.

A method for characterizing a fracture in a subterranean formation can include introducing a fluid having a plurality of pellets disposed therein into a wellbore. Each pellet can include a casing having a detonation material and an explosive material disposed therein. Movement of the nonexplosive material can generate a predetermined amount of energy in the form of friction-generated heat sufficient to detonate the explosive material. A pressure of the fluid can be increased to form the fracture in the subterranean formation, and at least a portion of the pellets can be disposed within the fracture. At least a portion of the pellets can be exploded. One or more signals from the exploded pellets can be received.

Another method for characterizing a fracture in a subterranean formation can include introducing a fluid having a plurality of pellets disposed therein into a wellbore. Each pellet can include a casing having a detonation material and an explosive material disposed therein. The detonation material can detonate the explosive material when the pellet is exposed to a predetermined temperature. A pressure of the fluid can be increased to form the fracture in the subterranean formation, and at least a portion of the pellets can be disposed within the fracture. An exothermic reaction of the fluid can be initiated. The fluid can include about 5 vol % to about 50 vol % of a metallic powder, about 50 vol % to about 95 vol % water, and about 0.1 vol % to about 3 vol % of a gelling agent. At least a portion of the pellets can be exploded when the fluid reaches the predetermined temperature. One or more signals from the exploded pellets can be received.

BRIEF DESCRIPTION OF THE DRAWINGS

So that the recited features can be understood in detail, a more particular description, briefly summarized above, can be had by reference to one or more embodiments, some of which are illustrated in the appended drawings. It is to be noted, however, that the appended drawings illustrate only typical embodiments, and are, therefore, not to be considered limiting of its scope, for the invention can admit to other equally effective embodiments.

DETAILED DESCRIPTION

Figure 1:
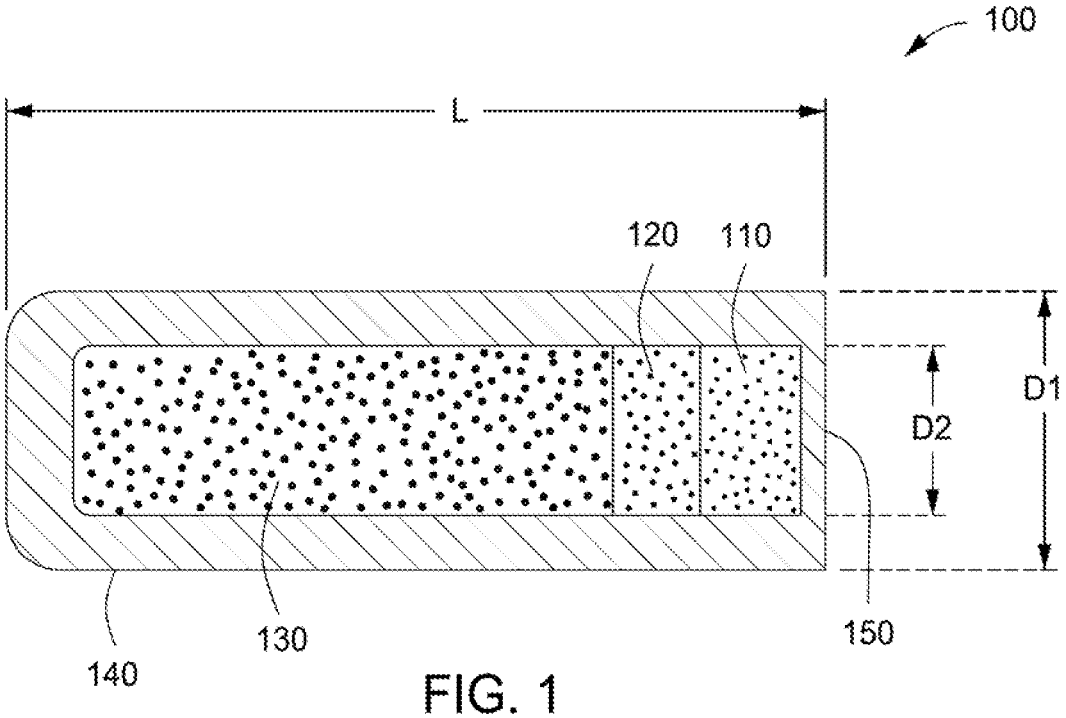
FIG. 1 depicts a cross-sectional view of an illustrative explosive pellet, according to one or more embodiments described.

FIG. 1 depicts a cross-sectional view of an illustrative explosive pellet 100, according to one or more embodiments. The pellet 100 can include an ignition material 110, a detonation material 120, and an explosive material 130 disposed within a housing or casing 140. The ignition material 110 can be any material or compound able to generate heat in an amount sufficient to ignite the detonation material 120 and/or the explosive material 130 or otherwise cause the detonation material 120 and/or the explosive material 130 to light, catch fire, combust, conflagrate, or erupt.

The ignition material 130 can be initiated by a trigger, such as heat. For example, the ignition material 110 can react when exposed to a temperature ("ignition temperature") of about 100° C. or more, about 110° C. or more, about 120° C. or more, about 130° C. or more, about 140° C. or more, about 150° C. or more, about 160° C. or more, about 170° C. or more, about 180° C. or more, about 190° C. or more, or about 200° C. or more. For example, the ignition temperature can be about 125° C. to about 175° C. or about 135° C. to about 165° C.

The ignition material 110 can be or include an oxidizing agent and a fuel agent. Suitable oxidizing agents can be or include silver nitrate ($AgNO_3$), potassium nitrate ($KNO_3$), sodium nitrate ($NaNO_3$), iron oxide ($Fe_2O_3$ or $Fe_3O_4$), lead tetroxide ($Pb_3O_4$), potassium perchlorate ($KClO_4$), sodium perchlorate ($NaClO_4$), or the like. Suitable fuel agents can be or include nitroguanidine ($CH_4N_4O_2$), nitrocellulose ($C_6H_7(NO_2)_3O_5$), or the like. The amount of the ignition material 110 loaded in the casing 140 can range from a low of about 10 mg, about 20 mg, about 30 mg, about 40 mg, or about 50 mg to a high of about 60 mg, about 80 mg, about 100 mg, about 150 mg, about 200 mg, or more. For example, the amount of the ignition material 110 can be about 10 mg to about 100 mg or about 20 mg to about 60 mg.

The detonation material 120 can be disposed between the ignition material 110 and the explosive material 130 within the casing 140. The detonation material 120 can be any material or compound capable of transitioning from a deflagration to a detonation and transferring the detonation to the explosive material 130 or otherwise setting off or causing the explosive material 130 to explode. The detonation material 120 can detonate the explosive material 130 when ignited by the ignition material 110 or when contacted or struck with sufficient force, as described in more detail below. The detonation material 120 can be or include lead azide ($Pb(N_3)_2$), silver azide ($AgN_3$), lead styphnate ($C_6HN_3O_8Pb$), diazodinitrophenol ("DDNP", $C_6H_2N_4O_5$), or the like.

The amount of the detonation material 120 loaded in the casing 140 can range from a low of about 10 mg, about 20 mg, about 50 mg, or about 100 mg to a high of about 150 mg, about 200 mg, about 300 mg, or more. For example, the amount of the detonation material 120 can be about 50 mg to about 300 mg or about 100 mg to about 200 mg. When the detonation material 120 is ignited by the ignition material 110, it can detonate the explosive material 130.

The explosive material 130 can be any material or compound capable of bursting, expanding, or otherwise exploding the capsule 140 upon initiation by the detonation material 120, thereby generating a seismic wave or signal. The explosive material 130 can be or include organic compounds that contain nitro groups ($NO_2$), nitrate groups ($ONO_2$), nitramine groups ($NHNO_2$), or the like. More particularly, the explosive material 130 can be or include pentaerythritol tetranitrate ("PETN", $C_5H_8N_4O_{12}$), cyclotrimethylene trinitramine ("RDX", $C_3H_6N_6O_6$), cyclotetramethylene tetranitramine ("HM", $C_4H_8N_8O_8$), hexanitrostilbene ("HNS", $C_{14}H_6N_6O_{12}$), or the like.

The explosive material 130 can be packed or pressed to between about 80% and about 99% of its theoretical maximum density within the casing 140, for example, about 95% of its theoretical maximum density. The amount of the explosive material 130 loaded in the casing 140 can range from a low of about 10 mg, about 25 mg, about 50 mg, about 100 mg, about 250 mg, or about 500 mg to a high of about 1.0 g, about 1.5 g, about 2.0 g, about 3.0 g, or more. For example, the amount of the explosive material 130 can be about 50 mg to about 1 g or about 500 mg to about 1.5 g. When the explosive material 130 is detonated by the detonation material 120, a seismic wave or signal can be generated that can be received by, for example, one or more geophones.

The casing 140 can be or include any container or housing for holding the ignition material 110, the detonation material 120, and/or the explosive material 130. The casing 140 can be any shape and size. The casing 140 can be made of any suitable material including metals and metal alloys, such as stainless steel, aluminum, or the like. The casing 140 can have a length (L) ranging from a low of about 0.5 cm, about 1.0 cm, about 1.5 cm, or about 2.0 cm to a high of about 2.5 cm, about 3.0 cm, about 4.0 cm, about 5.0 cm, or more. For example, the length (L) can be about 2.5 cm to about 4.0 cm. The casing 140 can have an outer cross-sectional diameter (D1) ranging from a low of about 0.5 cm, about 0.6 cm, about 0.7 cm, about 0.8 cm, or about 0.9 cm to a high of about 1.1 cm, about 1.2 cm, about 1.3 cm, about 1.4 cm, about 1.5 cm, or more. For example, D1 can be about 0.7 cm to about 1.0 cm. The casing 140 can have an inner cross-sectional diameter (D2) ranging from a low of about 0.3 cm, about 0.4 cm, about 0.5 cm, about 0.6 cm, or about 0.7 cm to a high of about 0.8 cm, about 0.9 cm; about 1.0 cm, about 1.1 cm, about 1.2 cm, or more. For example, D2 can be about 0.5 cm to about 0.7 cm. Accordingly, the thickness of the wall of the casing 140. (D1-D2) can range from a low of about 0.025 cm, about 0.05 cm about 0.1 cm, or about 0.2 cm to a high of about 0.3 cm, about 0.4 cm, about 0.5 cm, or more. For example, the thickness of the wall of the casing 140 can be about 0.05 cm to about 0.2 cm.

The casing 140 can include a lid or end cap 150 disposed at one end thereof. The end cap 150 can contain or seal the ignition material 110, detonation material 120, and explosive material 130 within the casing 140. The end cap 150 can be secured to the end of the casing 140 by laser welding, electron beam welding, tungsten inert gas ("TIG") welding, or the like. The end cap 150 can also be secured to the end of the casing 140 with glue or a suitable epoxy. The casing 140 can have a yield strength greater than about 50 MPa, about 100 MPa, about 250 MPa, about 300 MPa, about 350 MPa, about 400 MPa, about 450 MPa, about 500 MPa, or more. The casing 140 can also withstand a wellbore pressure greater than about 10 MPa, about 20 MPa, about 30 MPa, about 40 MPa, about 50 MPa, or more.

Figure 2:
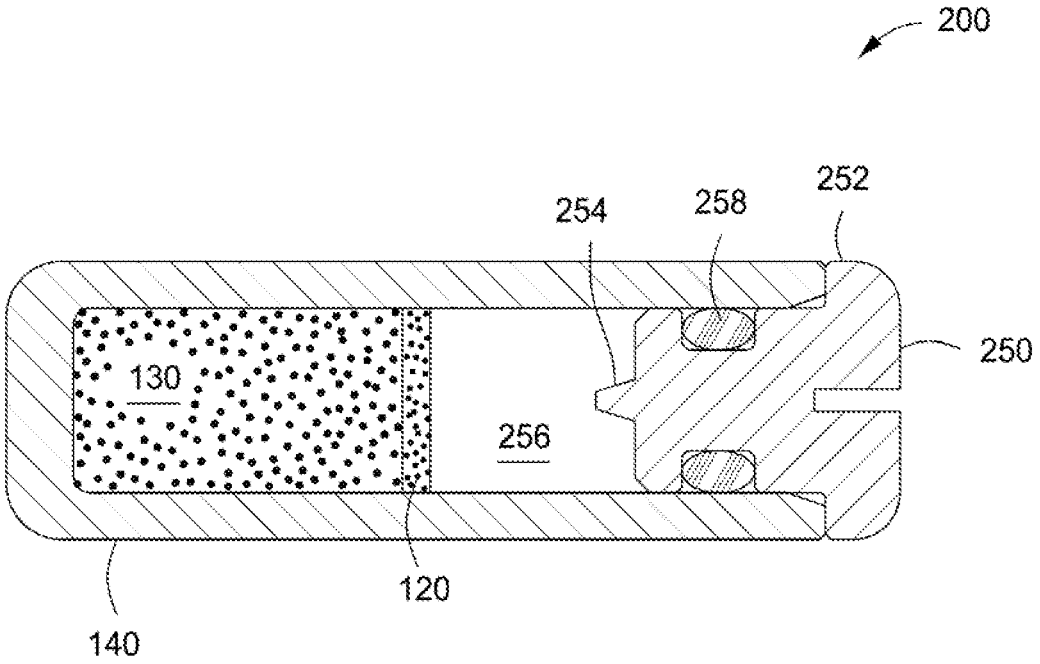
FIG. 2 depicts a cross-sectional view of another illustrative explosive pellet, according to one or more embodiments described.

FIG. 2 depicts a cross-sectional view of another illustrative explosive pellet 200, according to one or more embodiments. The pellet 200 can include an end cap 250 disposed at least partially within the casing 140 to seal the detonation material 120 and the explosive material 130 therein. The end cap 250 can be made of any nonexplosive material. The end cap 250 can also be made of a nonexplosive material that is dissolvable or degradable when exposed to wellbore or reservoir fluids, e.g., water, brine, hydrocarbons, and the like. The degradation rate of the end cap 250 can be a function of temperature, pressure, and/or exposure time to the wellbore or reservoir fluids.

The end cap 250 can include a shoulder 252 disposed on a first end thereof and a protrusion 254 disposed on a second end thereof. An outer diameter of the shoulder 252 can be greater than the inner diameter D2 of the casing 140. A gas 256 can be disposed between the end cap 250 and the detonation material 120. The gas 256 can be, for example, air at atmospheric pressure. An elastomeric seal or O-ring 258 can be disposed between at least a portion of the end cap 250 and the casing 140 to prevent fluid in the wellbore from leaking in to the casing 140.

As the shoulder 252 of the end cap 250 degrades, the pressure within the wellbore acting on the external side of the end cap 250 can be greater than the pressure of the gas 256 within the casing 140 creating a pressure differential that forces the end cap 250 to slide axially within the casing 140 in the direction of the detonation material 120. The pressure within the wellbore can range from a low of about 10 MPa, about 20 MPa, about 30 MPa, about 40 MPa, or about 50 MPa to a high of about 100 MPa, about 150 MPa, about 200 MPa, about 250 MPa, or more. As the end cap 250 slides toward the detonation material 120, the protrusion 254 can contact or "strike" the detonation material 120, generating friction that causes the detonation material 120 to detonate the explosive material 130.

Therefore, movement of the nonexplosive material (e.g., the end cap 250) can generate a predetermined amount of energy in the form of friction-generated heat sufficient to detonate the explosive material 130. As such, the detonation material 120 can trigger the detonation of the explosive material 130 when the pellet 200 is exposed to a fluid having temperature less than or equal to about 50° C., about 60° C., about 70° C., about 80° C., about 90° C., about 100° C., about 120° C., or about 140° C.

Figure 3:
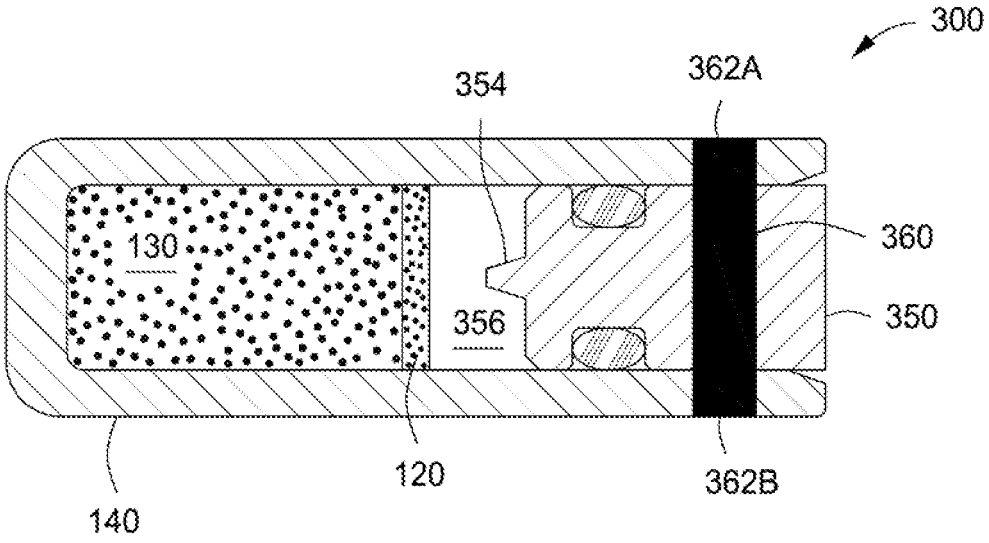
FIG. 3 depicts a cross-sectional view of another illustrative explosive pellet, according to one or more embodiments described.

FIG. 3 depicts a cross-sectional view of another illustrative explosive pellet 300, according to one or more embodiments. The pellet 300 can include an end cap 350 disposed at least partially within the casing 140 to seal the detonation material 120 and the explosive material 130 therein. The end cap 350 can be made of a nonexplosive material. Further, the end cap 350 can be made of a non-dissolvable or non-degradable material. The casing 140 can also include a pin 360 to hold the end cap 350 in place. The pin 360 can be made of a dissolvable or degradable material. In other words, the pin 360 can dissolve or degrade before the end cap 350. For example, the pin 360 can be made of a dissolvable aluminum, poly(lactic acid), polylactide, or the like. The pin 360 can extend at least partially (or completely) through the cross-sectional length, e.g, diameter, of the end cap 350 and the casing 140. Thus, the ends 362A, 362B of the pin 360 can be in fluid communication with the exterior of the casing 140.

The pin 360 can have a cross-sectional shape that is circular, ovular, square, rectangular, or the like. The pin 360 can be a cylinder having a cross-sectional length, e.g., diameter, ranging from a low of about 0.5 mm, about 1 mm, or about 2 mm to a high of about 4 mm, about 6 mm, about 8 mm, or more.

As the pin 360 degrades, the, pressure within the wellbore acting on the external side of the end cap 350 can be greater than the pressure of the gas 356 within the casing 140 creating a pressure differential that can shear the shoulder of the end cap 350 causing it to slide and accelerate axially within the casing 140 in the direction of the detonation material 120. As the end cap 350 slides toward the detonation material 120, the protrusion 354 can contact or strike the detonation material 120, generating friction that causes the detonation material 120 to detonate the explosive material 130.

Therefore, movement of the nonexplosive material (e.g., the end cap 350) can generate a predetermined amount of energy in the form of friction-generated heat sufficient to detonate the explosive material 130. As such, the detonation material 120 can trigger the detonation of the explosive material 130 when the pellet 300 is exposed to a fluid having temperature less than or equal to about 50° C., about 60° C., about 70° C., about 80° C., about 90° C., about 100° C., about 120° C., or about 140° C.

Instead of or in addition to being dissolvable, the pin 360 can be made of a material having a shear strength that is at least partially, temperature dependent. For example, the pin 360 can be made of a thermoplastic material such as ARLON® that is commercially available from Greene, Tweed, & Co., located in Kulpsville, Pa.

The temperature within the wellbore and reservoir, proximate the zone of interest (i.e., zone to be hydraulically fractured or stimulated), can range from a low of about 50° C., about 60° C., about 70° C., about 80° C., or about 90° C. to a high of about 100° C., about 150° C., about 200° C., about 250° C., about 300° C., or more. As the temperature increases, the strength of the pin 360 can decrease. Thus, a combination of the pressure and temperature within the wellbore can cause the pin 360 to break or shear, thereby allowing the end cap 350 to slide and accelerate axially within the casing 140 in the direction of the detonation material 120, as described above.

Figure 4:
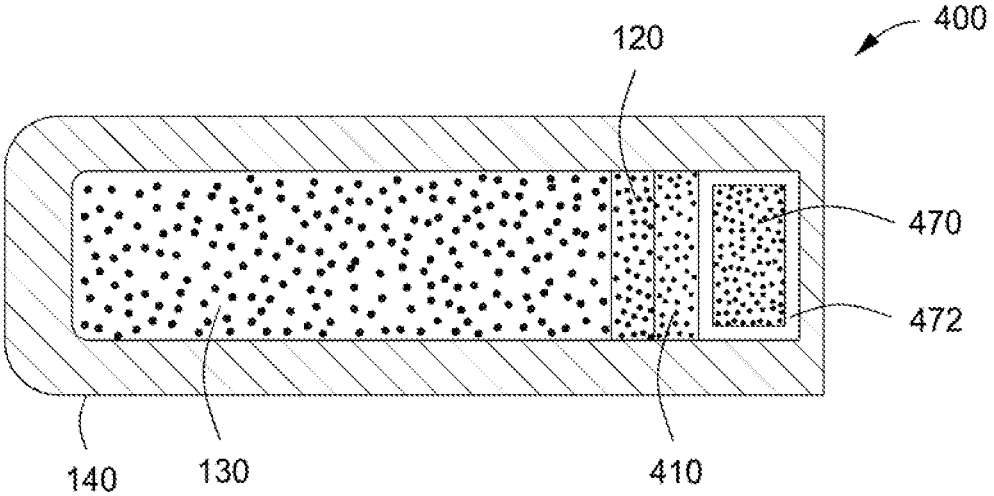
FIG. 4 depicts a cross-sectional view of another illustrative explosive pellet, according to one or more embodiments described.

FIG. 4 depicts a cross-sectional view of another illustrative explosive pellet 400, according to one or more embodiments. A first ignition material 410 can be disposed within the casing 140. The first ignition material 410 can be similar to the ignition material 110 described above with reference to FIG. 1. The pellet 400 can also include a second ignition material 470 disposed proximate the first ignition material 410 within the casing 140. The first ignition material 140 can be selected such that it is able to react exothermically with the second ignition material 470. The second ignition material 470 can be an acid that, when combined with the first ignition material 410, is adapted to ignite the detonation material 120. For example, the first ignition material can be or include potassium permanganate, and the like, and the second ignition material 470 can be or include sulfuric acid ($H_2SO_4$), and the like. The amount of the second ignition material 470 can range from a low of about 5 mg, about 10 mg, about 20 mg, about 30 mg, or about 40 mg to a high of about 60 mg, about 80 mg, about 100 mg, about 120 mg, or more. For example, the amount of the second ignition material 470 can be about 10 mg to about 50 mg.

The casing 140 can withstand a wellbore pressure greater than about 10 MPa, about 20 MPa, about 30 MPa, about 40 MPa, about 50 MPa, or more. However, the casing 140 can be deformed or crushed when exposed to a differential stress. As used herein, "differential stress" includes a force exerted on the casing 140 when the casing 140 is squeezed between two solid surfaces. For example, a fluid, e.g., a pad fluid, can be used to create hydraulic fractures in a reservoir rock. The pellet 400, which can be disposed within the fluid, can be lodged within a fracture. When the fluid flow stops, and the pressure is relieved, the walls of the fracture can at least partially close, thereby exerting a differential stress on the pellet 400.

The second ignition, material 470 can be disposed within a capsule 472 made of a nonexplosive material. The capsule 472 can be or include a glass ampule, glass tubing, or the like. The differential stress on the casing 140 can crack and break the capsule 472 allowing the ignition materials 410, 470 to combine. When the ignition materials 410, 470 are combined, they can ignite the detonation material 120, which can then detonate the explosive material 130.

Figure 5:
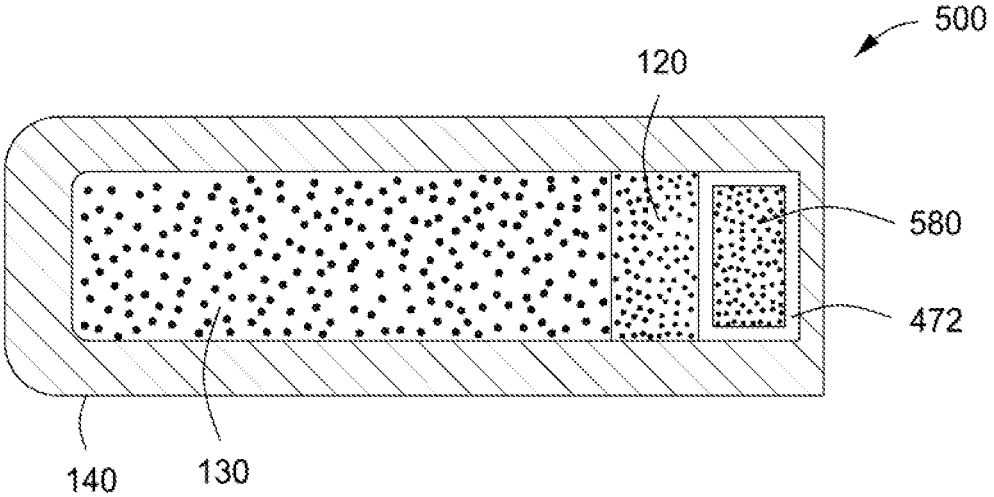
FIG. 5 depicts a cross-sectional view of another illustrative explosive pellet, according to one or more embodiments described.

FIG. 5 depicts a cross-sectional view of another illustrative explosive pellet 500, according to one or more embodiments. An ignition material 580 can be disposed within the casing 140 proximate the detonation material 120. The ignition material 580 can be a material that is sensitive to initiation by friction ("friction-sensitive material"). The ignition material 580 can be or include an oxidizer or oxidizing agent and a fuel agent. For example, the oxidizing agent in the ignition material 580 can be or include lead tetroxide ($Pb_3O_4$), silver nitrate ($AgNO_3$), potassium nitrate ($KNO_3$), sodium nitrate ($NaNO_3$), iron oxide ($Fe_2O_3$ or $Fe_3O_4$), potassium perchlorate ($KClO_4$), sodium perchlorate ($NaClO_4$), and the like. The fuel agent in the ignition material 580 can be or include tetrazine ($C_2H_2N_4$), lead azide ($Pb(N_3)_2$), silver azide ($AgN_3$), lead styphnate ($C_6HN_3O_8Pb$), antimony trisulfide ($Sb_2S_3$), zirconium (Zr), magnesium (Mg), and the like. Differential stress on the casing 140 can crack and break the capsule 472. When the capsule 472 cracks and breaks, the friction generated by the broken glass can cause the ignition material 580 to ignite the detonation material 120, which can then detonate the explosive material 130.

Therefore, movement of the nonexplosive material (e.g., the pieces of the capsule 472) can generate a predetermined amount of energy in the form of friction-generated heat sufficient to detonate the explosive material 130. As such, the detonation material 120 can trigger the detonation of the explosive material 130 when the pellet 500 is exposed to a fluid having temperature less than or equal to about 50° C., about 60° C., about 70° C., about 80° C., about 90° C., about 100° C., about 120° C., or about 140° C.

Figure 6:
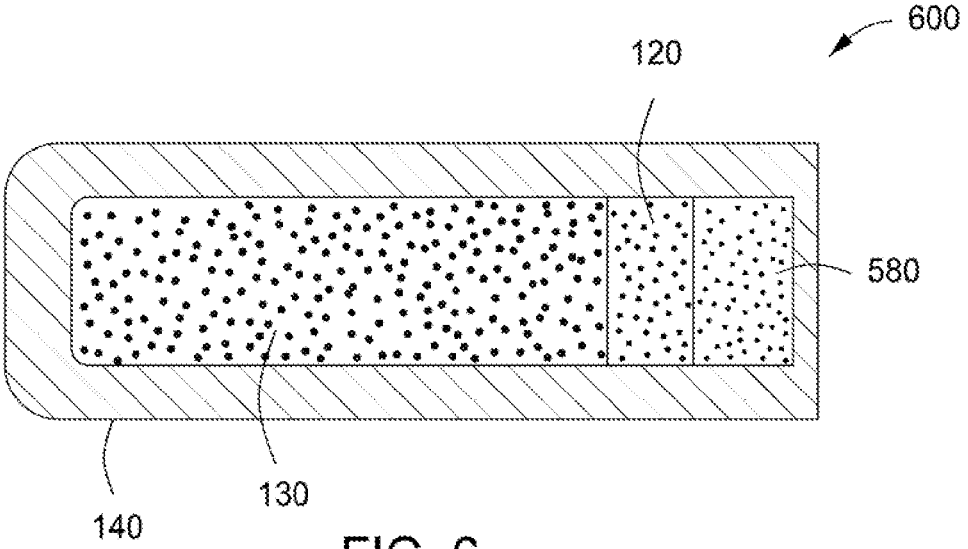
FIG. 6 depicts a cross-sectional view of another illustrative explosive pellet, according to one or more embodiments described.

FIG. 6 depicts a cross-sectional view of another illustrative explosive pellet 600, according to one or more embodiments. The ignition material 580 can be disposed proximate the detonation material 120; however, in at least one embodiment, the ignition material 580 is not disposed within the capsule 472. Rather the ignition material 580 can have nonexplosive coarse particles, such as crushed glass, hollow glass beads, or the like disposed therein. Thus, when the casing 140 is exposed to a differential stress, the coarse particles can rub together generating friction that will ignite the detonation material 120.

Therefore, movement of the nonexplosive material (e.g., coarse particles) can generate a predetermined amount of energy in the form of friction-generated heat sufficient to detonate the explosive material 130. As such, the detonation material 120 can trigger the detonation of the explosive material 130 when the pellet 600 is exposed to a fluid having temperature less than or equal to about 50° C., about 60° C., about 70° C., about 80° C., about 90° C., about 100° C., about 120° C., or about 140°C.

Figure 7:
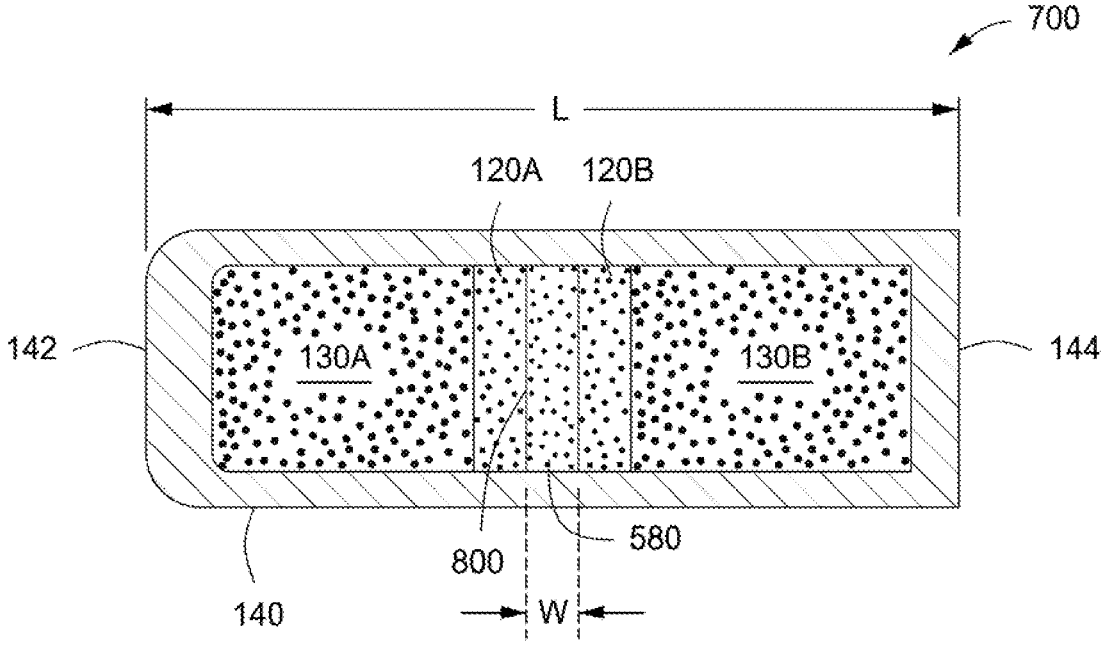
FIG. 7 depicts a cross-sectional view of another illustrative explosive pellet, according to one or more embodiments described.

FIG. 7 depicts a cross-sectional view of another illustrative explosive pellet 700, according to one or more embodiments. The pellet 700 can include the ignition material 580, the detonation material 120, and the explosive material 130 disposed within the casing 140. The ignition material 580 can be or include the friction-sensitive material described above. The ignition material 580 can be disposed proximate the detonation material 120. The ignition material 580 can be disposed generally centrally along the length (L) of the casing 140. For example, the ignition material 580 can be disposed between about 30% of the length (L) of the casing 140 and about 70% of the length (L) of the casing 140 from a first end 142 of the casing 140, or between about 40% of the length (L) of the casing 140 and about 60% of the length (L) of the casing 140 from the first end 142 of the casing 140.

The detonation material 120 can be disposed on one or both sides of the ignition. material 580. As shown, a first detonation material 120A is disposed on a first side of the ignition material 580, and a second detonation material 120B is disposed on a second side of the ignition material 580. The first detonation material 120A can be disposed between about 20% of the length (L) of the casing 140 and about 60% of the length (L) of the casing 140 from the first end 142 of the casing 140, or between about 30% of the length (L) of the casing 140 and about 50% of the length (L) of the casing 140 from the first end 142 of the casing 140. Similarly, the second detonation material 120B can be disposed between about 20% of the length (L) of the casing 140 and about 60% of the length (L) of the casing 140 from a second end 144 of the casing 140, or between about 30% of the length (L) of the casing 140 and about 50% of the length (L) of the casing 140 from the second end 144 of the casing 140.

The explosive material 130 can be disposed proximate one or both ends 142, 144 of the casing 140. As shown, a first explosive material 130A is disposed between the first end 142 of the casing 140 and the first detonation material 120A, and a second explosive material 130B is disposed between the second end 144 of the casing 140 and the second detonation material 120B. The first explosive material 130A can be disposed between the first end 142 of the casing 140 and about 45% of the length (L) of the casing 140 from the first end 142, or between the first end 142 of the casing 140 and about 35% of the length (L) of the casing 140 from the first end 142. Similarly, the second explosive material 130B can be disposed between the second end 144 of the casing 140 and about 45% of the length (L) of the casing 140 from the second end 144, or between the second end 144 of the casing 140 and about 35% of the length (L) of the casing 140 from the second end 144.

The amount of the first and second explosive materials 130A, 130B can each range froth a low of about 10 mg, about 25 mg, about 50 mg, or about 100 mg to a high of about 200 mg, about 400 mg, about 600 mg, about 800 mg, about 1.0 g, or more. For example, the amount of the first and second explosive materials 130A, 130B can each be about 50 mg to about 400 mg, or about 200 mg to about 500 mg.

Figure 8A:
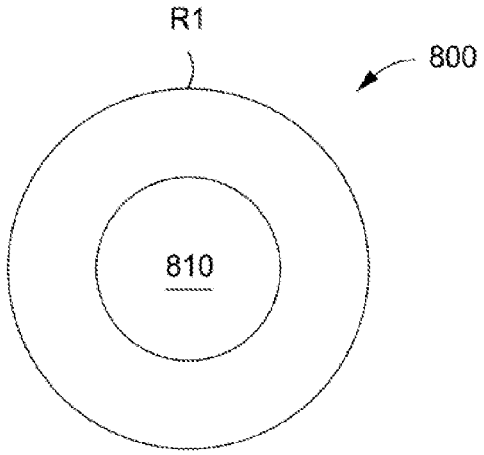
FIGS. 8A and 8B depict cross-sectional views of an illustrative brittle material disposed within the explosive pellet depicted in FIG. 7, according to one or more embodiments.
Figure 8B:
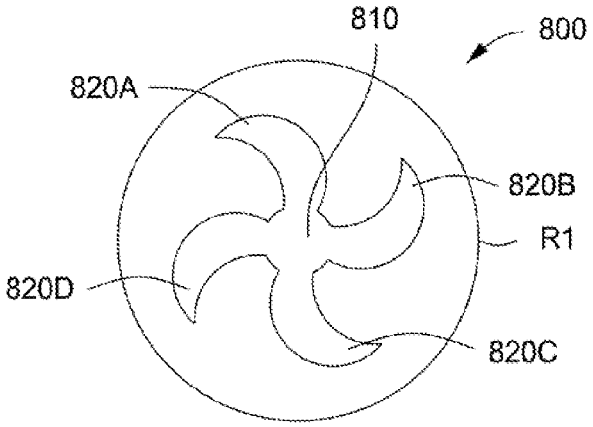

The ignition material 580 can be disposed, at least partially, within a nonexplosive brittle material 800. FIGS. 8A and 8B depict cross-sectional views of an illustrative brittle material 800 disposed within the pellet 700 shown in FIG. 7, according to one or more embodiments. When the pellet 700 is exposed to a differential stress, the casing 140 can collapse or be crushed, thereby causing the brittle material 800 disposed therein to collapse or be crushed. The collapsing or crushing of the brittle material 800 can generate friction, which can cause the ignition material 580 to ignite the detonation material 120A,B. The burning of the detonation material 120A,B can transition into a detonation and can detonate the explosive material 130A,B.

Therefore, movement of the nonexplosive material (e.g, the brittle material 800) can generate a predetermined amount of energy in, the form of friction-generated heat sufficient to detonate the explosive material 130. As such, the detonation material 120 can trigger the detonation of the explosive material 130 when the pellet 700 is exposed to a fluid having temperature less than or equal to about 50° C., about 60° C., about 70° C., about 80° C., about 90° C., about 100° C., about 120° C., or about 140° C.

The brittle material 800 can be any material or compound that can be crushed when the casing 790 is exposed to a differential stress within the wellbore. The differential stress for crushing the casing 140 and/or the brittle material 800 can range from a low of about 100 kg, about 200 kg, about 300 kg, about 400 kg, or about 500 kg to a high of about 750 kg, about 1000 kg, about 1500 kg, about 2000 kg, or more. The brittle material 800 can be made of strain-hardened steel, sintered metal powders, and the like.

The brittle material 800 can be disposed generally centrally along the length (L) of the casing 140 because the center of the casing 140 is likely to be the first portion of the casing 140 that collapses or is crushed. For example, the brittle material 800 can be disposed between about 30% of the length (L) of the casing 140 and about 70% of the length (L) of the casing 140 from the first end 142 of the casing 140, or between about 40% of the length (L) of the casing 140 and about 60% of the length (L) of the casing 140 from the first end 142 of the casing 140.

The brittle material 800 can define an inner volume 810 therein, and the ignition material 580 can be, at least partially, disposed or embedded within the inner volume 810. The inner volume 810 can have a cross-sectional shape that is circular, ovular, square, rectangular, or the like. Further, the inner volume 810 can include one or more fingers or notches 820A-D, as shown in FIG. 8B. The notches 820A-D can extend circumferentially and/or radially through the brittle material 800 and enable the brittle material 800 to be crushed more easily or provide better energy transfer to initiate the ignition material 580 disposed within the volume 810.

The brittle material can have an axial width W (see FIG. 7) ranging from a low of about 0.5 mm, about 1.0 mm, about 2 mm, about 3 mm, to a high of about 4 mm, about 5 mm, about 6 mm, about 7 mm, or more. For example, the axial width W can be between about 1 mm and about 5 mm. The brittle material 800 can have an outer diameter RI that is similar to the inner diameter of the casing 140 such that the brittle material 800 can be placed inside the casing 140. The outer diameter RI of the ring 800 can range from a low of about 0.2 cm, about 0.3 cm, about 0.4 cm, about 0.5 cm, or about 0.6 cm to a high of about 0.9 cm, about 1.0 cm, about 1.1 cm, about 1.2 cm, about 1.3 cm, or more. For example, the outer diameter RI can be between about 0.4 cm and about 0.9 cm.

Figure 9:
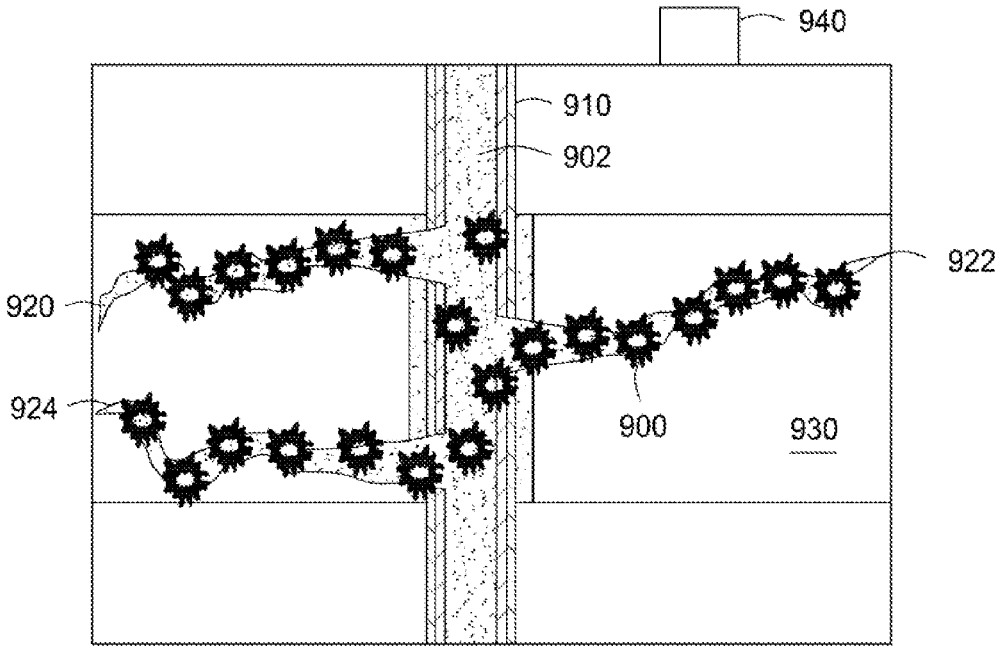
FIG. 9 represents a schematic illustration for mapping or monitoring hydraulic fractures in a subterranean formation, according to one or more embodiments described.

FIG. 9 represents a schematic illustration for mapping or characterizing hydraulic fractures 920, 922, 924 in a subterranean formation 930, according to one or more embodiments. In operation, one or more pellets 900 can be introduced to a wellbore 910. For example, the pellets 900 can be disposed within a fluid 902 that is introduced to the wellbore 910. The pellets 900 can be similar to the pellets 100, 200, 300, 400, 500, 600, 700 described above, and thus will not be described again in detail.

Hydraulic pressure can be applied to the fluid 902 in the wellbore 910 to create one or more fractures (three are shown 920, 922, 924) in the subterranean formation 930; however, in other embodiments, the fluid 902 can be introduced to the wellbore 910 during the formation of the fractures 920, 922, 924 and after the fractures 920, 922, 924 have been formed. The fluid 902 can contain proppant, or the fluid 902 can be proppant-free, e.g., a pad fluid.

The fluid 902 can flow into the fractures 920, 922, 924 leaving at least some of the pellets 900 disposed within the fractures 920, 922, 924. The pellets 900 can explode as a result of ternperature, pressure, differential stress, interaction with wellbore or reservoir fluid, combinations thereof, or the like, as described above. When the pellets 900 explode, they can generate seismic waves or signals. One or more geophones 940 can be adapted to receive the signals, and the signals can be used to map or characterize the fractures 920, 922, 924 in the formation 930.

FIGS. 10A-10D depict a method or process for detonating one or more pellets 1000, according to one or, more embodiments. The pellets 1000 can be disposed within a fluid 1002 that is introduced to the wellbore 1010. The pellets 1000 can be similar to the pellets 100, 200, 300, 400, 500, 600, 700, 900 described above, and thus will not be described again in detail.

The fluid 1002 can include a metallic powder, water, and a gelling agent, and can be incorporated with or without proppant. The metallic powder can serve as a fuel, and the water can serve as an oxidizer to generate an exothermic reaction within the wellbore 1010. The gelling agent can ensure that the reactants remain well-dispersed in the fluid 1002.

The metallic powder can be or include an energetic metal, such as magnesium (Mg), aluminum (Al), titanium (Ti), boron (B), beryllium (Be), combinations thereof, alloys thereof, or the like. The metallic powder in the fluid 1002 can range from a low of about 5 vol %, about 10 vol %, about 15 vol %, about 20 vol %, or about 25 vol % to a high of about 30 vol %, about 35 vol %, about 40 vol %, about 45 vol %, about 50 vol %, or more. The water in the fluid 1002 can range from a low of about 50 vol %, about 55 vol %, about 60 vol %, about 65 vol % or about 70 vol % to a high of about 75 vol %, about 80 vol %, about 85 vol %, about 90 vol %, about 95 vol %, or more. The gelling agent can include guar or its derivatives, poly(acrylamide-co-acrylic acid), carboxymethyl cellulose, hydroxyethyl cellulose, borate crosslinked gels, organometallic crosslinked gels, and the like. The gel in the fluid 1002 can range from a low of about 0.1 vol %, about 0.2 vol %, about 0.4 vol %, about 0.6 vol %, or about 0.8 vol % to a high of about 1 vol %, about 2 vol %, about 3 vol %, about 4 vol %, about 5 vol %, or more.

An illustrative fluid 1002 can include magnesium, water, and polyacrylamide-co-acrylic acid. At a full stoichiometric ratio, i.e., 1:1 ratio of magnesium atoms to water molecules, the fluid 1002 (when reacted) can generate a combustion wave at a temperature greater than about 1000° C., about 1200° C., about 1400° C., about 1600° C., about 1800° C., or about 2000° C. For example, the combustion wave can have a temperature greater than about 1700° C. As such, the temperature of the combustion wave can be sufficient to detonate the pellet 1000.

Figure 10A:
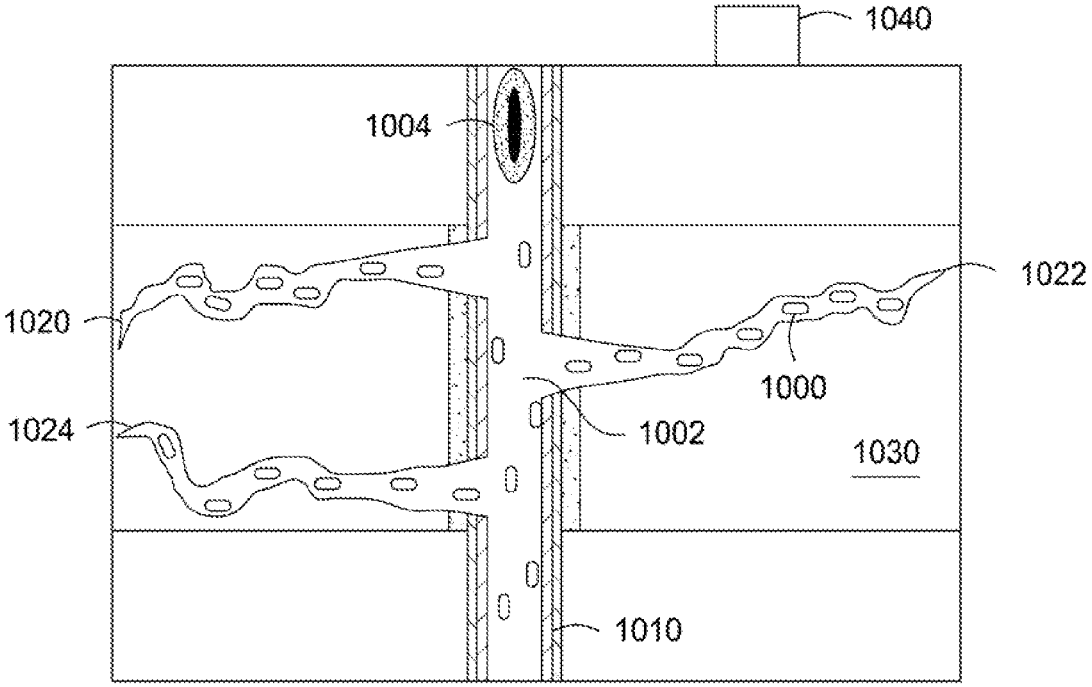
FIGS. 10A-10D represents a schematic illustration for detonating one or more pellets, according to one or more embodiments described.
Figure 10B:
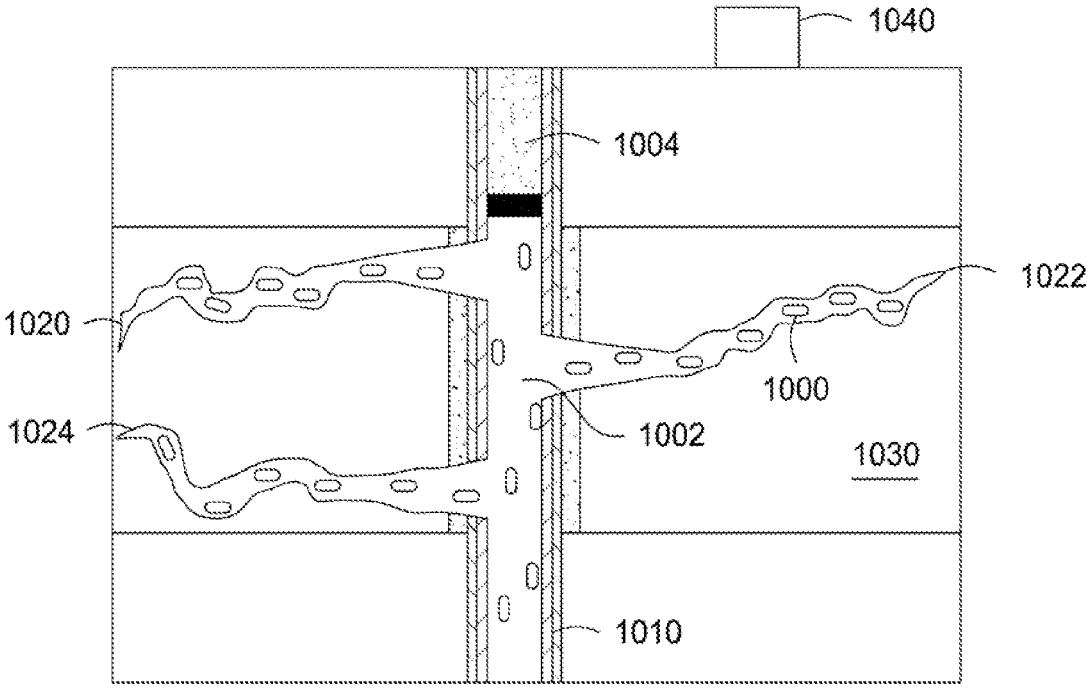

Referring now to FIG. 10A, the fluid 1002 can be introduced to the wellbore 1010. Pressure can be applied to the fluid 1002 from the surface, causing one or more fractures (three are shown 1020, 1022, 1024) to form in the subterranean formation 1030. The pellets 1000 can become disposed within the fractures 1020, 1022, 1024. An exothermic reaction 1004 of the fluid 1002 can then be initiated by propellant, electrical resistance heating, or the like. The reaction 1004 can propagate within the wellbore 1010, as shown in FIG. 10B.

Figure 10C:
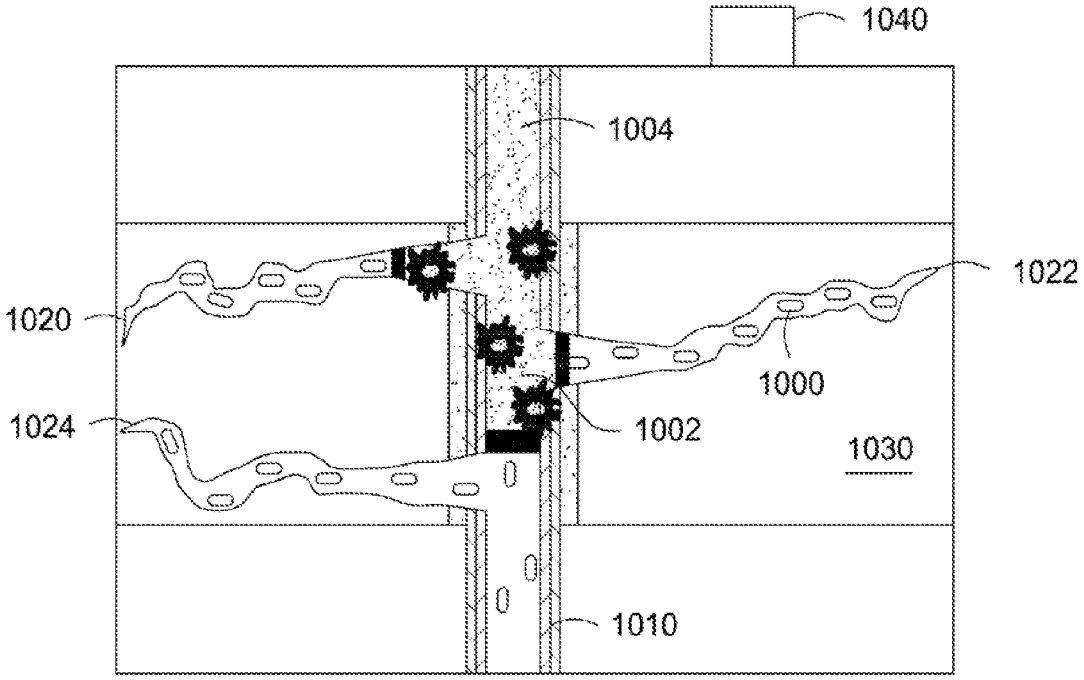

The temperature generated by the reaction 1004 can exceed the ignition temperature of the pellets 1000, causing the pellets 1000 to explode, as shown in FIG. 10C. The ignition temperature of the pellets 1000 can range from a low of about 50° C., about 75° C., about 100° C., about 150° C., or about 200° C. to a high of about 250° C., about 300° C., about 350° C., about 400° C., about 450° C., about 500° C., or more. For example, the ignition temperature can be about 100° C. to about 400° C. or about 100° C. to about 250° C.

Figure 10D:
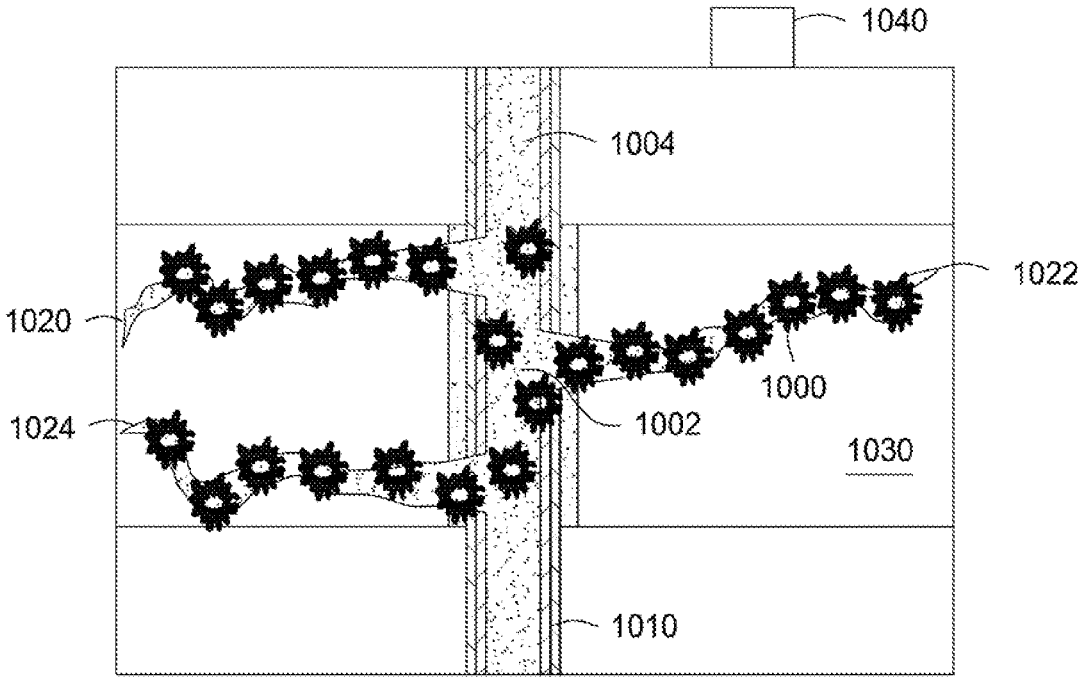

The reaction 1004 can propagate throughout the wellbore 1010 and the fractures 1020, 1022, 1024 causing the pellets 1000 to explode, as shown in FIG. 10D. As the pellets 1000 explode, they can generate seismic waves or signals that can be received by one or more geophones 1040.

Although only a few example embodiments have been described in detail above, those skilled in the art will readily appreciate that many modifications are possible in the example embodiments without materially departing from "Explosive Pellets." Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed is:

1. An explosive pellet, comprising:

a casing;

a detonation material disposed within the casing;

an explosive material disposed within the casing; and a nonexplosive material moveably disposed within the casing, wherein movement of the nonexplosive material generates a predetermined amount of energy in the form of friction-generated heat sufficient to detonate the explosive material, wherein the nonexplosive material has an internal volume and an ignition material disposed within the internal volume.

2. The explosive pellet of claim 1, wherein the detonation material detonates the explosive material when the casing is exposed to a fluid in a wellbore.

3. The explosive pellet of claim 2, wherein the fluid has a temperature less than or equal to about 140° C.

4. The explosive pellet of claim 1, wherein the nonexplosive material comprises a cap releasably coupled to an end of the casing and adapted to slide through the casing to strike the detonation material.

5. The explosive pellet of claim 4, wherein the cap comprises a protrusion disposed on a first end thereof and a shoulder disposed on a second end thereof.

6. The explosive pellet of claim 4, wherein the cap comprises a protrusion disposed on a first end thereof and a pin disposed at least partially through the cap to secure the cap in place.

7. The explosive pellet of claim 1, wherein the nonexplosive material comprises coarse particles disposed within the casing.

8. The explosive pellet of claim 7, wherein the coarse particles are selected from the group consisting of: crushed glass, hollow glass beads, and combinations thereof.

9. The explosive pellet of claim 1, further comprising an ignition material disposed within the casing comprising an oxidizing agent and a fuel agent, wherein the oxidizing agent is selected from the group consisting of silver nitrate, potassium nitrate, sodium nitrate, iron oxide, lead tetroxide, potassium perchlorate, sodium perchlorate, and combinations thereof, and wherein the fuel agent is selected from the group consisting of nitroguanidine, nitrocellulose, and combinations thereof.

10. The explosive pellet of claim 1, wherein the detonation material is selected from the group consisting of lead azide, silver azide, lead styphnate, diazodinitrophenol, and combinations thereof.

11. The explosive pellet of claim 1, wherein the explosive material is selected from the group consisting of pentaerythritol tetranitrate, cyclotrimethylene trinitramine, cyclotetramethylene tetranitramine, hexanitrostilbene, and combinations thereof.

12. A method for characterizing a fracture in a subterranean formation, comprising:

introducing a fluid having a plurality of pellets disposed therein into a wellbore, each pellet comprising:

a casing having an opening disposed at an end thereof and a cap covering the opening;

a detonation material disposed within the casing;

an explosive material disposed within the casing; and a nonexplosive material moveably disposed within the casing, wherein movement of the nonexplosive material generates a predetermined amount of energy in the form of friction-generated heat sufficient to detonate the explosive material, wherein the nonexplosive material has an internal volume and an ignition material disposed within the internal volume;

increasing a pressure of the fluid to form the fracture in the subterranean formation, wherein at least a portion of the pellets are disposed within the fracture;

exploding at least a portion of the pellets;

receiving one or more signals from the exploded pellets, degradeing at least a portion of a first end of the cap;

moving the cap within the casing and toward the detonation material; and striking the detonation material with a protrusion disposed on a second end of the cap.

13. A method for characterizing a fracture in a subterranean formation, comprising:

introducing a fluid having a plurality of pellets disposed therein into a wellbore, each pellet comprising:

a casing having an opening disposed at an end thereof and a cap covering the opening;

a detonation material disposed within the casing;

an explosive material disposed within the casing; and a nonexplosive material moveably disposed within the casing, wherein movement of the nonexplosive material generates a predetermined amount of energy in the form of friction-generated heat sufficient to detonate the explosive material, wherein the nonexplosive material has an internal volume and an ignition material disposed within the internal volume;

increasing a pressure of the fluid to form the fracture in the subterranean formation, wherein at least a portion of the pellets are disposed within the fracture;

exploding at least a portion of the pellets;

receiving one or more signals from the exploded pellets, degrading at least a portion of a pin disposed at least partially through the cap;

moving the cap within the casing and toward the detonation material; and striking the detonation material with a protrusion disposed on an end of the cap.

* * * * *